US009533333B2

(12) United States Patent
Ozeki et al.

(10) Patent No.: US 9,533,333 B2
(45) Date of Patent: Jan. 3, 2017

(54) CLEANING METHOD AND CLEANING APPARATUS

(71) Applicant: DENSO CORPORATION, Kariya, Aichi-pref. (JP)

(72) Inventors: Yasuhito Ozeki, Okazaki (JP); Keita Yanagawa, Anjo (JP)

(73) Assignee: DENSO CORPORATION, Kariya (JP)

( * ) Notice: Subject to any disclaimer, the term of this patent is extended or adjusted under 35 U.S.C. 154(b) by 524 days.

(21) Appl. No.: 13/958,090

(22) Filed: Aug. 2, 2013

(65) Prior Publication Data

US 2014/0060587 A1 Mar. 6, 2014

(30) Foreign Application Priority Data

Sep. 5, 2012 (JP) ..... 2012-195037

(51) Int. Cl.

| | |
|---|---|
| ***B08B 3/00*** | (2006.01) |
| ***B08B 7/00*** | (2006.01) |
| ***B08B 3/02*** | (2006.01) |
| ***B08B 5/02*** | (2006.01) |

(52) U.S. Cl.

CPC ..... *B08B 7/0021* (2013.01); *B08B 3/02* (2013.01); *B08B 5/02* (2013.01); *B08B 2203/007* (2013.01)

(58) Field of Classification Search

None

See application file for complete search history.

(56) References Cited

U.S. PATENT DOCUMENTS

| | | | | |
|---|---|---|---|---|
| 5,120,370 | A * | 6/1992 | Mori | B08B 3/00 134/105 |
| 2007/0169793 | A1 | 7/2007 | Shimada et al. | |
| 2012/0017946 | A1 | 1/2012 | Yanagawa | |

FOREIGN PATENT DOCUMENTS

| | | | |
|---|---|---|---|
| JP | A-2002-212769 | | 7/2002 |
| JP | 2004025144 | A | 1/2004 |
| JP | A-2005-296874 | | 10/2005 |
| JP | 2007227878 | A | 9/2007 |
| JP | 2010100900 | A | 5/2010 |
| JP | A-2011-228385 | | 11/2011 |
| JP | 2012030173 | A | 2/2012 |
| JP | A-2012-024685 | | 2/2012 |

OTHER PUBLICATIONS

Dictionary.com, Superheat, May 26, 2016, Dictionary.com, p. 1-4.*

(Continued)

*Primary Examiner* — Binh X Tran
*Assistant Examiner* — David Cathey, Jr.
(74) *Attorney, Agent, or Firm* — Oliff PLC

(57) ABSTRACT

The cleaning apparatus includes a reservoir tank for reserving a cleaning fluid, a pressure-feed unit for feeding the cleaning fluid while pressurizing the cleaning fluid above the atmospheric pressure, a heating unit for heating the cleaning fluid pressure-fed from the pressure-feed unit above an atmospheric pressure boiling point of the cleaning fluid, a gas supply unit for supplying a gas and an injection unit connected to the heating unit and the gas supply unit for injecting the cleaning fluid pressurized by the pressure-feeding unit and heated by the heating unit as a pressurized superheated cleaning fluid and the gas supplied from the gas supply unit to the member at the same time.

3 Claims, 5 Drawing Sheets

(56) References Cited

OTHER PUBLICATIONS

Chaplin, Water Structure and Science, May 4, 2016, Martin Chaplin, 5 pages.*
Calumet, White Mineral Oil, Jul. 26, 2009, Calumet, 2 pages and date stamp.*
Science Lab, Mineral Oil MSDS, Nov. 1, 2010, Science Lab, p. 1-5.*
Oct. 23, 2014 Office Action issued in Japanese Application No. 2012-195037.

* cited by examiner

CLEANING METHOD AND CLEANING APPARATUS

This application claims priority to Japanese Patent Application No. 2012-195037 filed on Sep. 5, 2012, the entire contents of which are hereby incorporated by reference.

BACKGROUND OF THE INVENTION

1. Field of the Invention

The present invention relates to a cleaning method and a cleaning apparatus used for performing the cleaning method.

2. Description of Related Art

Generally, to remove contamination or foreign matter from a member (a machined part or component, for example) which has adhered to the member during a manufacturing process of the member, or to remove remaining chemical liquid from the member which has been applied to the surface of the member during a surface treatment process of the member, a cleaning apparatus is used for injecting water or cleaning fluid to the member. Japanese Patent Application Laid-open No. 2005-296874 describes such a cleaning apparatus of the two-fluid nozzle type, which has a fluid injection nozzle for injecting fluid and a gas injection nozzle for injecting gas radially outward for reducing the mean particle diameter of droplets of the fluid injected from the fluid injection nozzle.

However, the cleaning apparatus of the two-fluid nozzle type as described in the above patent document has a problem in that it consumes a large amount of gas because the gas-liquid volume ratio representing the volume ratio of the gas injected from the gas injection nozzle to the fluid injected from the fluid injection nozzle has to be kept between 800 and 1000 in order to make the droplets sufficiently small.

SUMMARY

An exemplary embodiment provides a cleaning method for cleaning a member to be cleaned including:

a step of preparing a pressurized superheated cleaning fluid by pressurizing a cleaning fluid above atmospheric pressure and heating the pressurized cleaning fluid above an atmospheric pressure boiling point of the cleaning fluid;

a step of supplying a gas; and a step of injecting the pressurized superheated cleaning fluid and the gas to the member at the same time.

The exemplary embodiment provides also a cleaning apparatus including:

a reservoir tank for reserving a cleaning fluid;

a pressure-feed unit for feeding the cleaning fluid while pressurizing the cleaning fluid above the atmospheric pressure;

a heating unit for heating the cleaning fluid pressure-fed from the pressure-feed unit above an atmospheric pressure boiling point of the cleaning fluid;

a gas supply unit for supplying a gas; and an injection unit connected to the heating unit and the gas supply unit for injecting the cleaning fluid pressurized by the pressure-feeding unit and heated by the heating unit as a pressurized superheated cleaning fluid and the gas supplied from the gas supply unit to a member to be cleaned at the same time.

According to the exemplary embodiment, it is possible to reduce amounts of a cleaning fluid and a gas used for cleaning a member to be cleaned such as a machined part or component without reducing detergency.

Other advantages and features of the invention will become apparent from the following description including the drawings and claims.

PREFERRED EMBODIMENTS OF THE INVENTION

Figure 1:
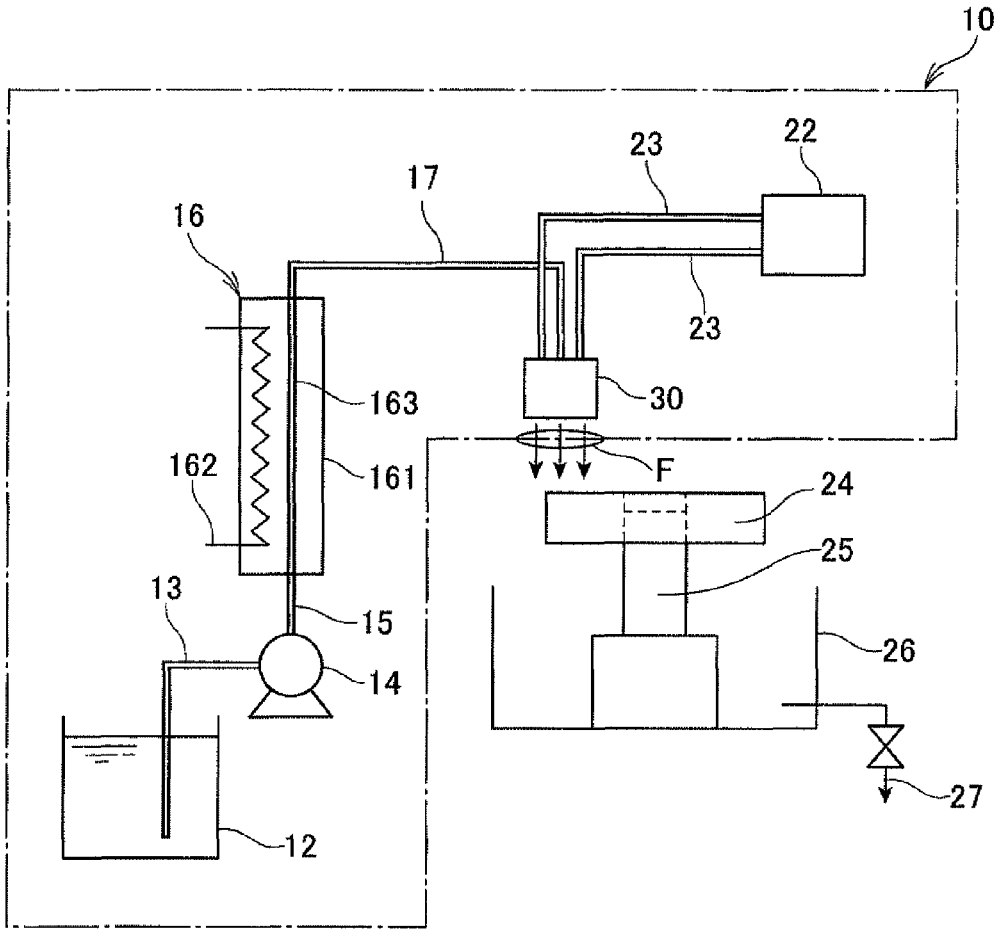
FIG. 1 is a diagram schematically showing the structure of a cleaning apparatus according to a first embodiment of the invention.

In the below-described embodiments, the same or corresponding components are represented by the same reference numerals or characters.

First Embodiment

A cleaning apparatus 10 according to a first embodiment of the invention is described with reference to FIGS. 1 and 2. The cleaning apparatus 10 includes a reservoir tank 12, a booster pump 14 as a pressure-feed unit, a heat exchanger 16 as a heating unit, a compressor 22 as a gas supply unit and a nozzle block 30 as an injection unit. The cleaning apparatus 10 is for removing contamination from a vehicle component, which has adhered during a pre-process such as a machining process, in order to ensure the reliability and quality of the vehicle component necessary for a post-process. In FIG. 1, the arrows F indicate the direction in which a cleaning fluid and a gas injected from the nozzle block 30 flow.

The reservoir tank 12 is for reserving the cleaning fluid. The cleaning fluid used in the cleaning apparatus 10 may be water or water-containing alcohol with an added antirust agent. Preferably, the water-containing alcohol is an alcohol having a boiling point higher than 40° C. at the atmospheric pressure and being azeotropic with water. The reservoir tank 12 is connected with the booster pump 14 through a pipe 13.

The booster pump 14 is for pressurizing the cleaning fluid reserved in the reservoir tank 12 and discharging it. The discharged cleaning fluid is supplied to the heat exchanger 16 through a pipe 15 in the state of being pressurized above the atmospheric pressure.

The heat exchanger 16 includes a housing 161, a heater 162 and a pipe 163. The housing 161 houses the heater 162 and the pipe 163. The pipe 163 is connected to the pipe 15. The heater 162 heats the cleaning fluid pressurized above the atmospheric pressure and passing through the pipe 163 to a certain temperature higher than the boiling point of the cleaning fluid at the atmospheric pressure. This certain temperature may be set close to the boiling point of the pressurized cleaning fluid. The cleaning fluid flowing through a pipe 17 connected to the pipe 163 is in a pressurized superheated state where it is pressurized above the atmospheric pressure and at the temperature higher than its boiling point at the atmospheric pressure. The cleaning fluid in the pressurized superheated state flowing through the pipe 17 is sent to the nozzle block 30.

The compressor 22 is for sending atmospheric air to the nozzle block 33 through pipes 23.

Figure 2A:
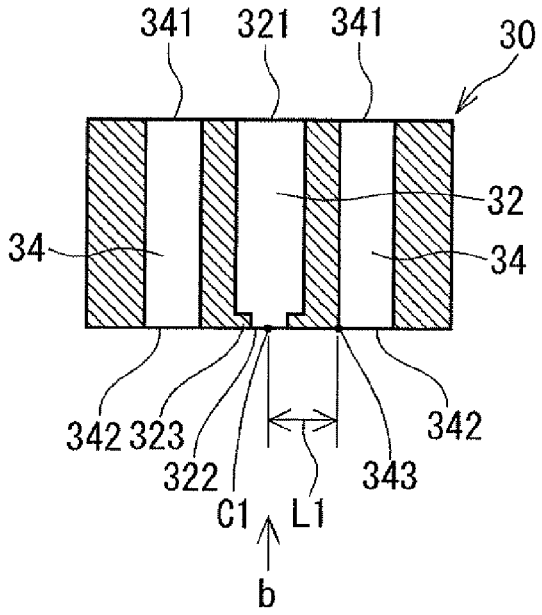
FIG. 2A is a cross-sectional view of a nozzle block of the cleaning apparatus according to the first embodiment of the invention.
Figure 2B:
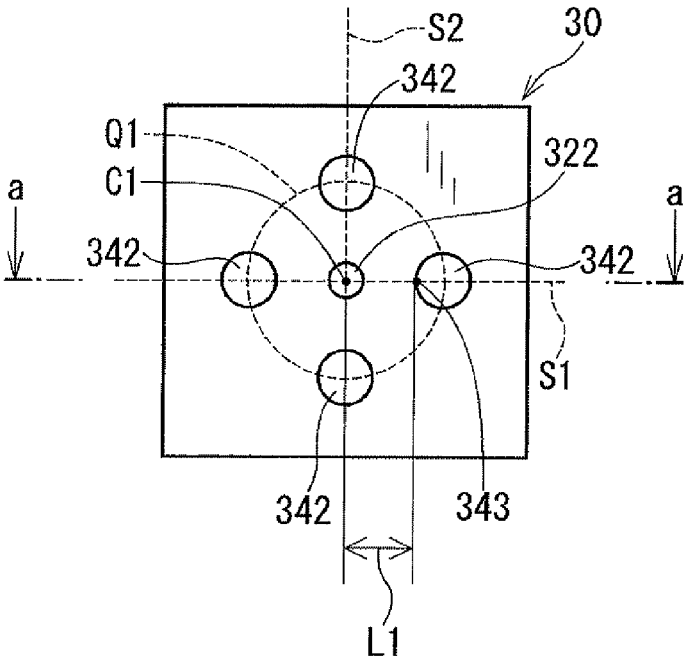
FIG. 2B is a bottom view of the nozzle block of the cleaning apparatus according to the first embodiment of the invention.

As shown in FIGS. 2A and 2B, the nozzle block 30 is formed of a metal shaped in a cube. The nozzle block 30 functions as a two-fluid nozzle capable of injecting fluid and gas separately and at the same time. The nozzle block 30 is disposed at a position capable of cleaning a member 24 to be cleaned. The nozzle block 30 includes a fluid passage 32 and gas passages 34 formed so as to extend axially in parallel.

The fluid passage 32 is located at the approximately center of the nozzle block 30. The fluid passage 32 is provided with a fluid inlet hole 321 connected to the pipe 17. The fluid passage 32 is provided also with a fluid injection hole 322 formed of a projection 323 projecting radially inside from the inner wall of the fluid passage 32. Accordingly, the inner diameter of the fluid injection hole 322 is smaller than the inner diameter of the fluid passage 32. In this embodiment, the inner diameter of the fluid injection hole 322 is 0.5 mm so that the cleaning fluid flowing through the fluid passage 32 can be kept in the pressurized state.

The gas passages 34 are formed so as to be parallel with the fluid passage 32. In this embodiment, the gas passages 4 are four in number which are located on the same concentric circle with a center on the center axis of the fluid passage 32. Each gas passage 34 is provided with a gas inlet hole 341 connected to the pipe 23 and a gas injection hole 342. As shown in FIG. 2B, two of the four gas injection holes 342 are located on a virtual straight line S1 passing through the center C1 of the fluid injection hole 322, and the other two gas injection holes 342 are located on a virtual straight line S2 passing through the center C1 and perpendicular to the virtual straight line S1. Each of the four gas injection holes 342 is formed such that the distance L1 between the point 343 closest of all the points on its circular outer edge to the fluid injection hole 322 and the center C1 of the fluid injection hole 322 is 10 mm. Accordingly, the four gas injection holes 342 are located on a virtual circle Q1 with the center C1. The open areas of the gas injection holes 342 are set to such a value that the gas-liquid volume ratio representing the volume ratio of the air injected from the gas injection holes 342 to the cleaning fluid injected from the fluid injection hole 322 is smaller than 100.

Next, a cleaning method performed using the cleaning apparatus 10 described above is explained. The cleaning fluid reserved in the reservoir tank 12 is pressurized above the atmospheric pressure by the booster pump 14, and heated to a temperature higher than its boiling point at the atmospheric pressure by the heat exchanger 16, so that the cleaning fluid is in the pressurized superheated state (a pressurized superheated cleaning fluid preparing step). The pressurized superheated cleaning fluid is sent to the nozzle block 30 through the pipe 17. On the other hand, air is supplied to the nozzle block 30 by the compressor 22 (a gas supplying step).

The nozzle block 30 injects the pressurized superheated cleaning fluid and the air to the member 24 to be cleaned in the atmosphere from the fluid injection hole 322 and the gas injection holes 342, respectively, at the same time. The pressurized superheated cleaning fluid injected into the atmosphere transfers to the steam phase to become cleaning steam. The air injected from the gas injection holes 342 forms a laminar flow with the pressurized superheated cleaning fluid injected from the fluid injection hole 322. The air acts as a carrier enabling the cleaning fluid to reach the member 24 to be cleaned. Part of the cleaning steam condenses to form droplets of the cleaning fluid (cleaning droplets) while being entrained to the member 24 by the air.

The member 24 to be cleaned is set at a position facing the nozzle block 30 by a rotatable support 25. The rotatable support 25 is driven to rotate to change the position of the member 24 relative to the nozzle block 30. Alternatively, the nozzle block 30 may be configured to move relative to the member 24. The nozzle block 30 may be provided plurally.

The cleaning steam carried by the air and the cleaning droplets strike the surface of the member 24 to remove contamination or chemical liquid adhering to the surface of the member 24. At this time, a thin layer of the cleaning fluid is formed on the surface of the member 24. Contamination or chemical liquid which has not been removed by the collision between the cleaning steam or cleaning droplets and the surface of the member 24 dissolves into the layer of the cleaning fluid. The cleaning fluid containing contamination or chemical liquid is recovered in a recovery tank 26 disposed below the member 24. The cleaning fluid stored in the recovery tank 26 is discharged from a drain 27.

Next, results of first and second experiments of the cleaning method which was performed by the inventors are explained.

In the first experiment, a test piece was cleaned using the nozzle block fixed at a position 100 mm vertically above the surface of the test piece. The nozzle block used in the first experiment includes a fluid injection hole having an inner diameter of 0.5 mm, and four gas injection holes having an inner diameter of 2.0 mm and located at even intervals on a circle concentric with the fluid injection hole with the distance L1 being 10 mm. As the pressurized superheated cleaning fluid, there was used water having a boiling point of 100° C. at the atmospheric pressure, pressurized to a gauge pressure of 0.4 Mpa and heated to 150° C. This pressurized superheated cleaning fluid was injected to the test piece for 3 seconds together with compressed air by such an amount as to make the gas-liquid volume ratio equal to 50. The test piece was a SUS-made member having dimensions of 15 mm by 30 mm by 2 mm and a surface roughness of 0.8 z. In the first experiment, there were used two kinds of such a test piece, one coated with the water-insoluble oil YUSHIRONCUT ABAS KZ216 manufactured by YUSHIRO CHEMICAL INDUSTRY CO., LTD by 200 $mg/dm^2$, and one coated with the water-soluble oil TOYO-COOL 3A-666 manufactured by TOYOTA CHEMICAL ENGINEERING CO., LTD by 200 $mg/dm^2$. An amount of oil adhering to the surface of each of the test pieces after completion of the cleaning was quantified by a solvent extraction/ultraviolet absorption method using the extracting agent HC-UV45 manufactured by TOSOH CORPORATION. The amount of oil adhering to the surface of the test piece coated with the water-insoluble oil YUSHIRONCUT ABAS KZ216 after completion of the cleaning was below 2 mg/dm$^2$. The amount of oil adhering to the surface of the test piece coated with the water-soluble oil TOYOCOOL 3A-666 after completion of the cleaning was below 1 mg/dm$^2$.

In the second experiment, a cylindrical machined component having a diameter of 100 mm and a length of 30 mm for use in a vehicle heat exchanger was cleaned. The machined component was coated with the water-soluble oil TOYOCOOL 3A-666 by 20 mg/dm$^2$, and then set to the rotatable support of the cleaning apparatus. The machined component was rotated at 120 rpm during the cleaning together by the rotatable support. The nozzle block was disposed such that the fluid injection hole is at a distance of 150 mm from the surface of the machined component, and forms an injection angle of 45 degrees with the machined component. As the pressurized superheated cleaning fluid, there was used water having a boiling point of 100° C. at the atmospheric pressure, pressurized to a gauge pressure of 0.3 Mpa and heated to 130° C. This pressurized superheated cleaning fluid was injected to the machined component for 20 seconds together with compressed air by such an amount as to make the gas-liquid volume ratio equal to 50. An amount of oil adhering to the surface of the machined component after completion of the cleaning was quantified by a solvent extraction/ultraviolet absorption method using the extracting agent HC-UV45. The amount of oil adhering to the surface of the machined component coated with the water-soluble oil TOYOCOOL 3A-666 after completion of the cleaning was below 3 mg/dm$^2$.

According to the cleaning method using the cleaning apparatus of the first embodiment, the cleaning fluid is pressurized above the atmospheric pressure, heated above the boiling point at the atmospheric pressure and injected as the pressurized superheated cleaning fluid together with air to a member to be cleaned in the atmosphere so as to form a laminar mixture flow. The pressurized superheated cleaning fluid injected so as to form a laminar mixture flow with the air transforms to the cleaning steam, and part of the cleaning steam changes to the cleaning micro droplets. Hence, the pressurized superheated cleaning fluid and the air injected from the nozzle block 30 form a three-phase mixture flow of the cleaning steam, cleaning droplets and air. The three-phase mixture flow strikes the member 24 to be cleaned, as a result of which contamination or chemical liquid adhered to the surface of the member 24 is removed by physical action. Further, contamination or chemical liquid which could not been removed by the physical action is removed by chemical action. That is, the contamination or chemical liquid dissolves into the thin layer of the cleaning fluid formed on the surface of the member 24. As explained above, according to the cleaning method descried above, it is possible to form the cleaning steam and cleaning micro droplets which are effective in cleaning the member 24 without consuming a large amount of gas. Hence, since the gas-liquid volume ratio representing the volume ratio of the air injected from the gas injection holes to the cleaning fluid injected from the fluid injection hole can be made small, it is possible to reduce the consumption of the cleaning fluid and air without reducing the detergency.

As explained above, in the cleaning method using the cleaning apparatus of the first embodiment, contamination or chemical liquid can be removed from the surface of a member to be cleaned by dissolving it into a thin layer of the cleaning fluid formed from the cleaning steam. Accordingly, since the cleaning fluid remains on the surface of a member to be cleaned for a long time, it becomes unnecessary to provide a member dedicated for holding the cleaning fluid on the surface of the member to be cleaned. Hence, according to the cleaning method described above, it is possible to clean a large member.

Second Embodiment

Next, a cleaning apparatus according to a second embodiment of the invention is described with reference to FIG. 3. The second embodiment differs from the first embodiment in the shape of the nozzle block.

Figure 3A:
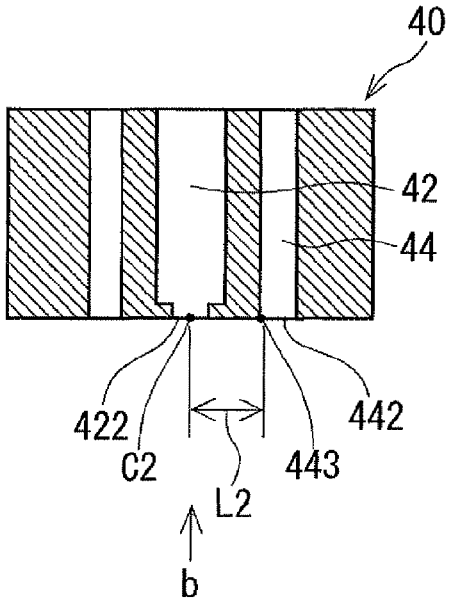
FIG. 3A is a cross-sectional view of a nozzle block of a cleaning apparatus according to a second embodiment of the invention.
Figure 3B:
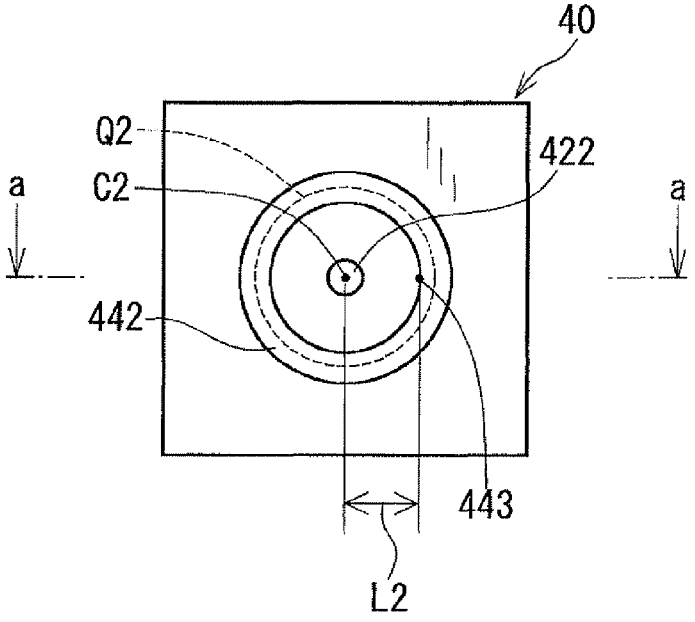
FIG. 3B is a bottom view of the nozzle block of the cleaning apparatus according to the second embodiment of the invention.

FIG. 3A is a cross-sectional view of a nozzle block 40 of the cleaning apparatus according to the second embodiment of the invention. FIG. 3B is a bottom view of the nozzle block 40. The nozzle block 40 is formed with one fluid passage 42 and one gas passage 44 having an annular cross section. As shown in FIG. 3B, the gas passage 44 is provided with an annular gas injection hole 442 along a virtual circle Q2 whose center is the same as a center C2 of a fluid injection hole 422 of the fluid passage 42. The gas injection hole 442 is formed such that the distance L2 between the point 443 closest of all the points on its circular outer edge to the fluid injection hole 422 and the center C2 of the fluid injection hole 422 is 10 mm. The open area of the gas injection hole 442 is set to such a value that the gas-liquid volume ratio is smaller than 100. The cleaning method performed using the cleaning apparatus of the second embodiment provides the same advantages as those provided by the cleaning method performed using the cleaning apparatus of the first embodiment.

Third Embodiment

Next, a cleaning apparatus according to a third embodiment of the invention is described with reference to FIG. 4. The third embodiment differs from the second embodiment in the shape of the nozzle block.

Figure 4A:
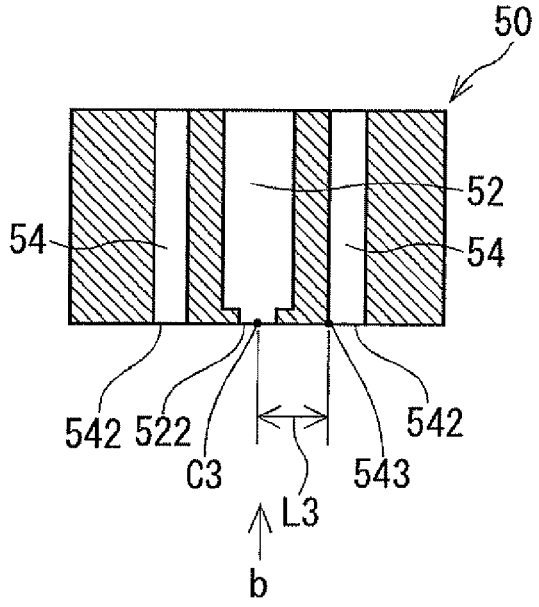
FIG. 4A is a cross-sectional view of a nozzle block of a cleaning apparatus according to a third embodiment of the invention.
Figure 4B:
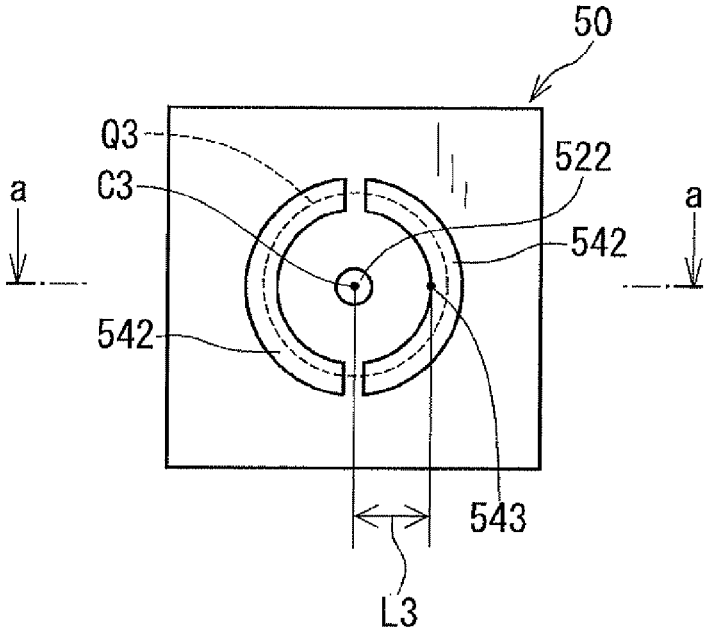
FIG. 4B is a bottom view of the nozzle block of the cleaning apparatus according to the third embodiment of the invention.

FIG. 4A is a cross-sectional view of the nozzle block 50 of the cleaning apparatus according to the third embodiment of the invention. FIG. 4B is a bottom view of the nozzle block 50. The nozzle block 50 is formed with one fluid passage 52 and two gas passages 54 having an arcuate cross-section. As shown in FIG. 4B, each of the gas passages 54 is provided with a gas injection hole 542 having an arcuate shape along a virtual circle Q3 whose center is the same as a center C3 of a fluid injection hole 522 of the fluid passage 52. Each gas injection hole 542 is formed such that the distance L3 between the point 543 closest of all the points on its circular outer edge to the fluid injection hole 522 and the center C3 of the fluid injection hole 522 is 10 mm. The open areas of the gas injection holes 542 are set to such a value that the gas-liquid volume ratio is smaller than 100. The cleaning method performed using the cleaning apparatus of the third embodiment provides the same advantages as those provided by the cleaning method performed using the cleaning apparatus of the first embodiment.

Fourth Embodiment

Next, a cleaning apparatus according to a fourth embodiment of the invention is described with reference to FIG. 5. The fourth embodiment differs from the first embodiment in the shape of the nozzle block.

Figure 5A:
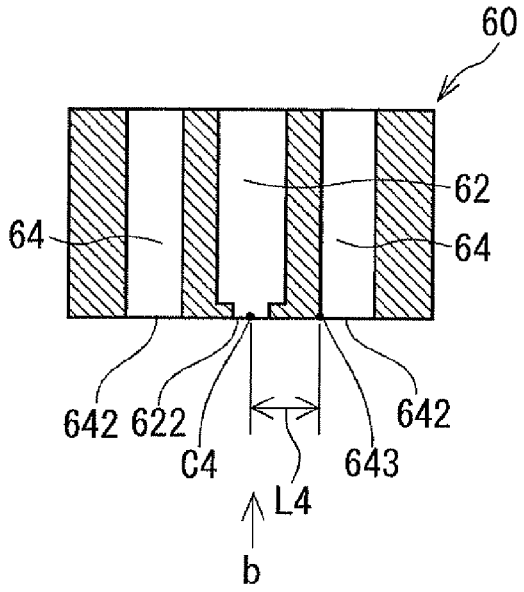
FIG. 5A is a cross-sectional view of a nozzle block of a cleaning apparatus according to a fourth embodiment of the invention.
Figure 5B:
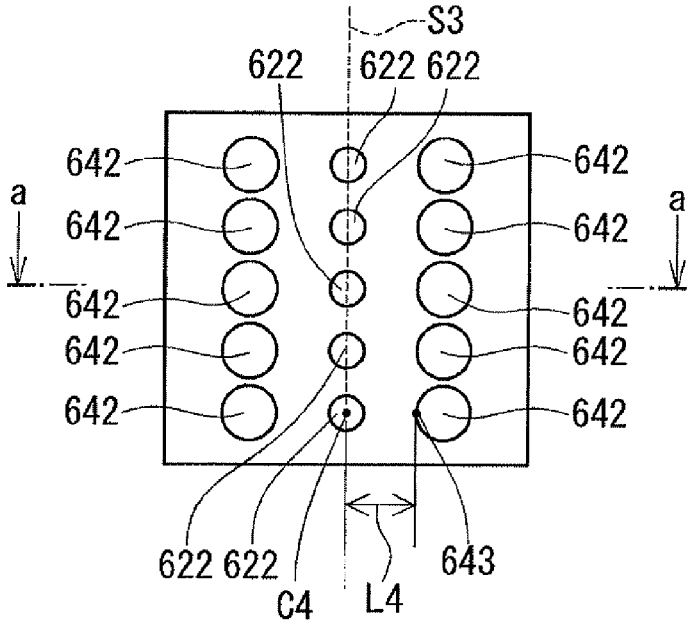
FIG. 5B is a bottom view of the nozzle block of the cleaning apparatus according to the fourth embodiment of the invention.

FIG. 5A is a cross-sectional view of a nozzle block 60 of the cleaning apparatus according to the fourth embodiment of the invention. FIG. 5B is a bottom view of the nozzle block 60. The nozzle block 60 is formed with five fluid passages 62 and ten gas passages 64. As shown in FIG. 5B, each of the five fluid passages 62 is provided with a fluid injection hole 622. The five fluid injection holes 622 are linearly arranged along a virtual straight line S3. Five of the ten gas passages 64 are provided with five fluid injection holes 622 linearly arranged on one side of the virtual straight line S with a certain distance to the virtual straight line S. The other five gas passages 64 are provided with five fluid injection holes 622 linearly arranged on the other side of the virtual straight line S with the certain distance to the virtual straight line S. Each gas injection hole 642 is formed such that the distance L4 between the point 643 closest of all the points on its circular outer edge to the fluid injection hole 622 and the center C4 of the fluid injection hole 622 is 10 mm. The open areas of the gas injection holes 642 are set to such a value that the gas-liquid volume ratio is smaller than 100. The cleaning method performed using the cleaning apparatus of the fourth embodiment provides the same advantages as those provided by the cleaning method performed using the cleaning apparatus of the first embodiment.

Other Embodiments (a) In the above embodiments, the cleaning fluid is pressurized using a booster pump. However, the cleaning fluid may be pressurized using any means other than a booster pump, if the pressure of the cleaning fluid can be increased above the atmospheric pressure.

(b) In the above embodiments, the gas supplied from a compressor as a gas supply means to the nozzle block is air. However, the gas to be supplied from the compressor to the nozzle block is not limited to air. It may be an inactive gas such as nitrogen. The gas supply means is not limited to a compressor. It may be a pressurized gas cylinder, a fax or a blower.

(c) In the above embodiments, the inner diameter of the fluid injection hole is 0.5 mm. However, it may be any value within the range of 0.1 mm to 1.5 mm.

(d) In the first embodiment, the nozzle block is formed with one fluid passage and four gas passages. In the second embodiment, the nozzle block is formed with one fluid passage and one gas passages. In the third embodiment, the nozzle block is formed with one fluid passage and two gas passages. In the fourth embodiment, the nozzle block is formed with five fluid passage and ten gas passages. However, the numbers of the fluid and gas passages may be determined according to individual circumstances.

(e) In the above embodiments, the distance of the point closest of all the points on its circular outer edge to the fluid injection hole and the center of the fluid injection hole is 10 mm. However, the distance is not limited to 10 mm. This distance may be set to any appropriate value, if the gas injected from the gas injection hole (or holes) and the cleaning fluid injected from the fluid injection hole (or holes) can form a laminar mixture flow. For example, it may be less than 10 mm.

The above explained preferred embodiments are exemplary of the invention of the present application which is described solely by the claims appended below. It should be understood that modifications of the preferred embodiments may be made as would occur to one of skill in the art.

What is claimed is:

1. A cleaning method for cleaning a member to be cleaned, the method comprising:

preparing a pressurized superheated cleaning fluid by pressurizing a cleaning fluid above atmospheric pressure and heating the pressurized cleaning fluid above an atmospheric pressure boiling point of the cleaning fluid;

supplying a gas; and injecting the pressurized superheated cleaning fluid and the gas at the same time so that the pressurized superheated cleaning fluid is carried by the gas to the member, wherein after being injected, the pressurized superheated cleaning fluid transforms to cleaning steam and part of the cleaning steam liquefies to form cleaning droplets while being carried to the member by the gas, thereby forming a three-phase mixture flow of the cleaning steam, the cleaning droplets, and the gas that strikes the member.

2. The cleaning method according to claim 1, wherein the cleaning fluid is water or water-containing alcohol.

3. The cleaning method according to claim 1, wherein the cleaning fluid is alcohol (i) that contains water, (ii) whose boiling point at atmospheric pressure is above 40° C., and (iii) that is azeotropic with water.

* * * * *